US006017428A

United States Patent [19]

Hill et al.

[11] Patent Number: 6,017,428

[45] Date of Patent: Jan. 25, 2000

[54] ELECTROWINNING CELL

[75] Inventors: Eldan L. Hill, Layton; Charles O. Gale, Bountiful, both of Utah

[73] Assignee: Summit Valley Equipment and Engineering, Inc., North Salt Lake, Utah

[21] Appl. No.: 08/893,958

[22] Filed: Jul. 16, 1997

[51] Int. Cl.[7] ..... C25C 7/00; C25C 7/02

[52] U.S. Cl. ..... 204/242; 204/284; 204/286; 204/293

[58] Field of Search ..... 204/242, 284, 204/286, 288, 287, 294, 293; 205/565, 566, 571

[56] References Cited

U.S. PATENT DOCUMENTS 2,529,237 11/1950 Turner et al. ..... 204/284 X
2,615,839 10/1952 Willier ..... 204/284 X
4,643,819 2/1987 Heroguelle ..... 204/284 X
5,454,917 10/1995 Mattison et al. ..... 205/567 X
5,711,865 1/1998 Caesar ..... 204/284 X
5,783,050 7/1998 Coin et al. ..... 204/290 R X

*Primary Examiner*—Donald R. Valentine
*Attorney, Agent, or Firm*—Mallinckrodt & Mallinckrodt

[57] ABSTRACT

An electrowinning cell and a cathode for use therein for removal of gold or other precious metals from a solution thereof in a suitable electrolyte. The cathode comprises a perforated steel plate wrapped in layers of woven wire mesh secured thereto. The cathode design is such that the cathode may be cleared of deposited gold sludge by use of an ordinary garden hose spray nozzle without its removal from the cell, making the electrowinning process faster and more economical.

14 Claims, 5 Drawing Sheets

ELECTROWINNING CELL

BACKGROUND OF THE INVENTION

1. Field

The field of the invention is electrolytic recovery of gold from solutions thereof, more particularly to treat carbon eluates and the like to deposit gold-bearing sludges for further refining upon cathode assemblies.

2. Prior Art

Prior art electrowinning, for cathodic production of gold, generally involves the displacement of gold from an aqueous alkaline cyanide solution in an electrolytic cell carrying alternately spaced anodes and cathodes. At proper voltage, deposition of the metal starts upon the cathodes, at a rate depending upon solution parameters, such as conductivity, concentration of ionic species present, temperature and applied cell current. The source of the deposited gold is ionic gold-cyanide within the caustic solution. When parameters are favorable, a fluffy, porous deposit of elemental gold forms upon the cathode, and in some instances then falls upon the cell floor. Other conditions may produce plating upon the cathode, which may be acceptable with some approaches to the electrowinning recovery of gold.

Typically, conditions are brought about within the cell to promote the deposition of gold-bearing sludge upon the cathode structure. The cathode structure typically comprises a cathodic basket which is variously filled with wool of steel or stainless steel, upon the strands of which the gold bearing sludge forms and from which it must be subsequently removed. In prior art devices, the cathode structure must be removed from the electrowinning cell to dislodge and recover the sludge from the steel wool, which is packed into thick layers within baskets, and requires very vigorous washing with water. The baskets surround the cathodes and both are together removed from the electrolytic cell. Strong jets of water are directed perpendicularly to the surface of the cathode plate. Generally, the basket must be disassembled to provide access to the wool for thorough sludge removal. This periodic procedure slows the gold recovery process, and increases its cost.

Therefore, there exists a need for electrowinning cathodes not requiring removal from the cell for dislodging the deposited sludge.

BRIEF SUMMARY OF THE INVENTION

With the foregoing in mind, the present invention provides a cathode structure adapted for the recovery of the deposited sludge without its removal from the electrowinning cell. The cathodes are of minimum thickness so that they may be efficiently packaged into the electrolyte containing cell. The cathodes comprise a central perforated steel plate and a thin layer thereabout of a few wraps of woven mesh of small diameter stainless steel wire. No basket structures are used to contain the mesh. Instead, the mesh wrappings are secured fully exposed to the central cathode plate by wire ties, ratchet buttons or the like. Sludge flushing water may be directed substantially vertical, parallel to the cathode plates. All cathodes and anodes may remain in the cell without hindering sludge removal.

The cell may be packed with a greater number of the thinner, basketless cathode structures, so that the total amount, and surface area of the steel mesh packed into the complete cell may in fact be greater than that of the steel wool of the basket cathode structures.

To remove sludge from the inventive cathodes, the flow of electrolyte into the cell is halted, and the electrolyte in the cell decanted, before washing the sludge from the cathodes into the cell bottom. The cell bottom is preferably sloped to direct the sludge to a collection area. However, the sludge may with some electrolyte solutions be dislodged without emptying the cell of electrolyte. That is, the cathodes may be cleaned by a water spray or jet applied below the surface of the electrolyte, dislodging the sludge to fall to the bottom of the bath while the flow of electrolyte is allowed to continue. With this approach, there is virtually no interruption of the continuous operation of the electrolytic cell, except to empty the bottom of the cell of sludge when necessary. The below-electrolyte flushing of the sludge may add beneficial agitation, enhancing the rate of gold deposition upon the cathode. It may also dislodge particulate foreign material built up in the steel mesh of the cathode. Such build-up tends to reduce voidage, restricting electrolyte flow and reducing cell efficiency. The periodic agitation may help to avoid dead regions within the cathode where gold deposition cannot occur because of increased hydrogen evolution as sludge builds up upon the steel mesh of the cathode.

The inventive cathode structure, by permitting frequent in situ flushing of the sludge may consequently be exploited to produce an electrolytic cell more efficiently packed with cathodes than would otherwise be possible. The spacing of the electrodes is often limited by the danger of the cathode deposit reaching the anode during operation. Frequent, easy dislodgment of the sludge clearly permits more closely placed anodes and cathodes throughout the cell. Frequent cleaning of the mesh of the cathodes also helps to clear the perforations through the cathode plates.

With the inventive cathode design, less mesh wire surface area is provided per cathode plate than is provided by the wool surface area in the conventional basket cathodes. However, because, as mentioned above, increased numbers of cathodes may be used, so that a given electrolytic cell volume may nevertheless incorporate as much or more steel mesh surface area per unit of cell volume as do the conventional basket cathodes.

The principal objective of the inventive cathode construction is to increase the efficiency and economy of operation of electrowinning cells.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
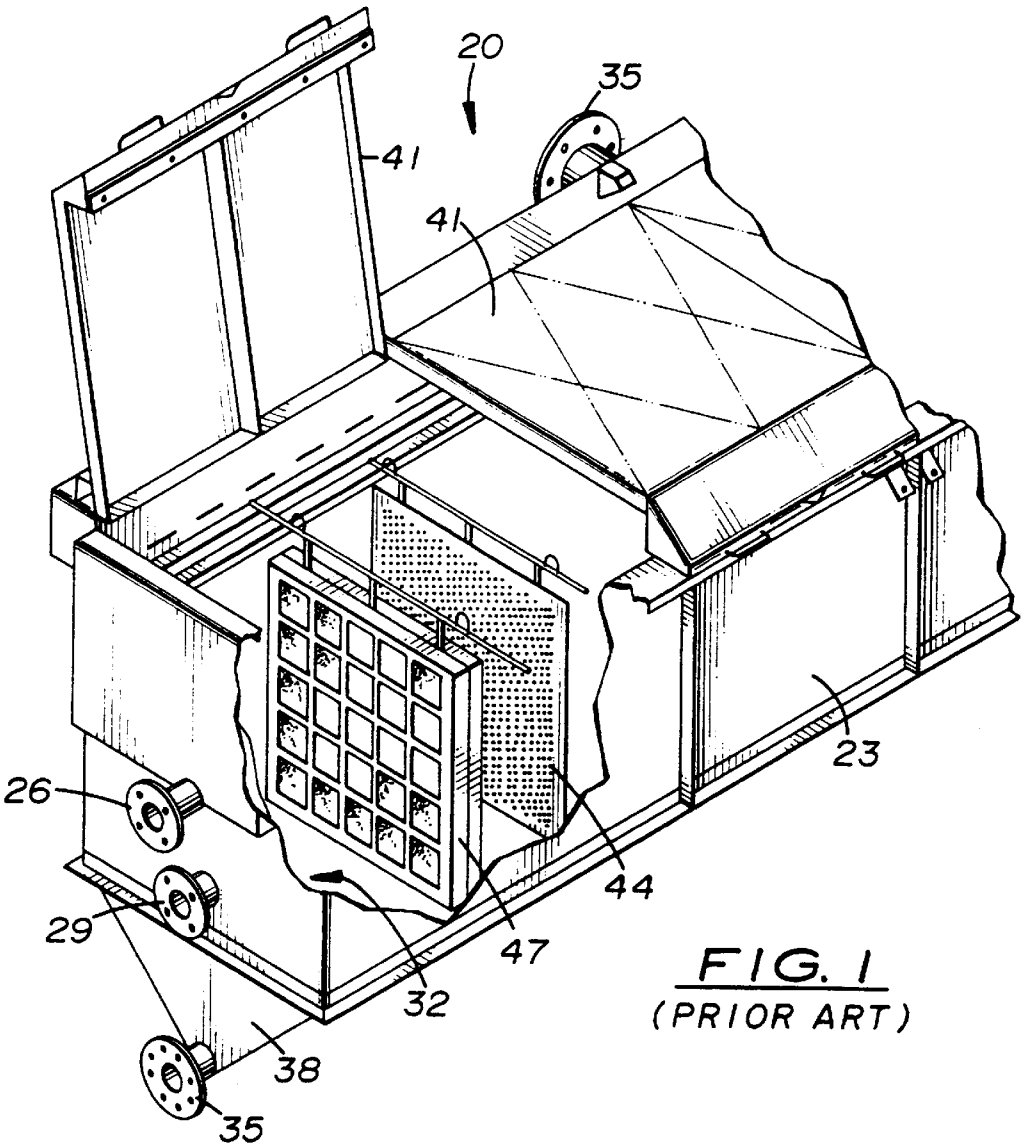
FIG. 1 (PRIOR ART)
FIG. 1 is a fragmentary partially broken view of a prior art electrowinning cell having a prior art anode and a prior art basket type cathode.
Figure 6:
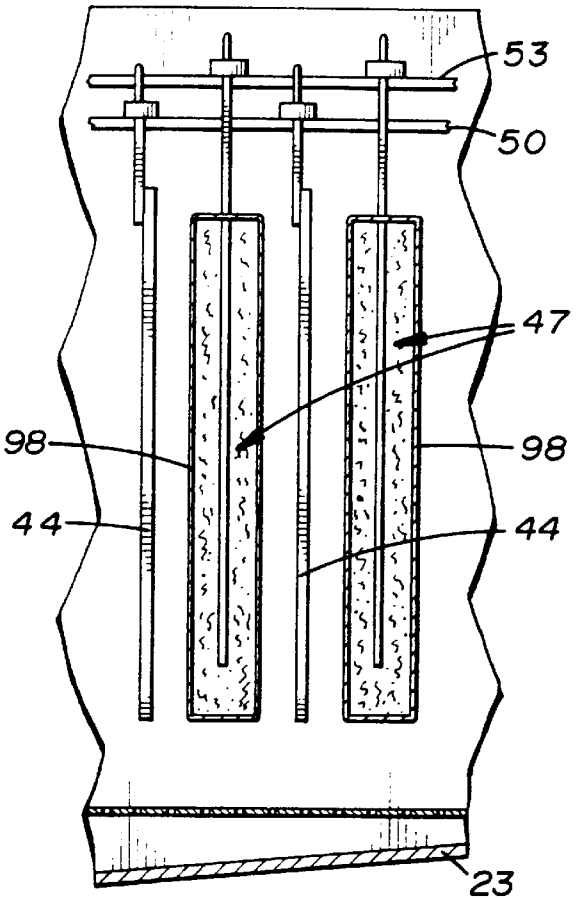
FIG. 6 (PRIOR ART)
FIG. 6, a fragmentary cross sectional view of such prior art anodes and basket type cathodes.
Figure 11:
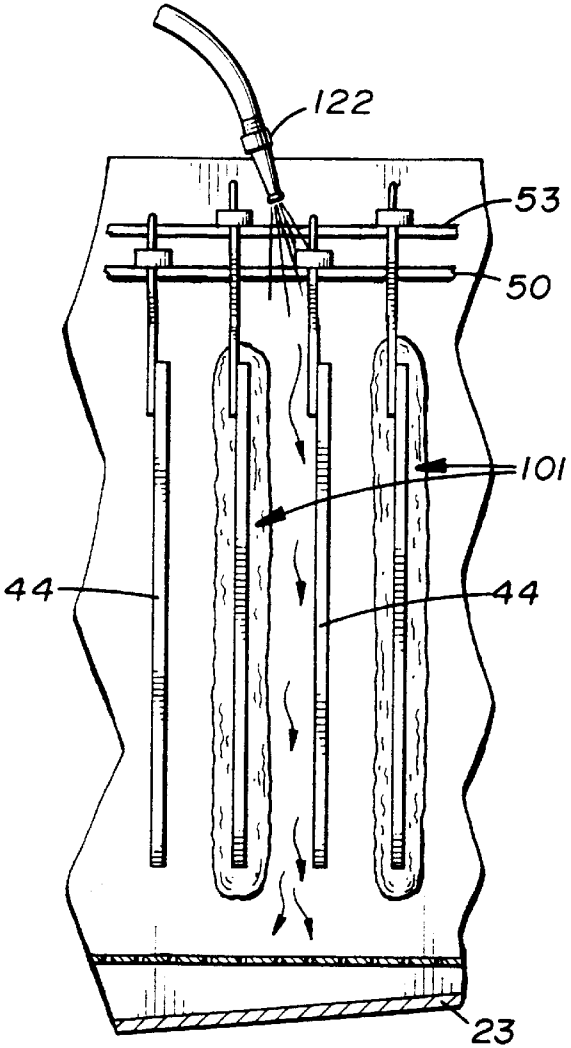
FIG. 11, a fragmentary cross sectional view of such invnetive electrowinning cell showing the iventive cathodes juxtaposed such prior art anodes, and indicating the washing spray for removing the sludge therefrom.

An electrolytic cell assembly 20 (FIG. 1) called an electrowinning cell, comprises a cell body 23, an inlet 26 for, typically, a caustic cyanide-water solution (not shown) of high grade gold, silver, or other dissolved metals. Body 23 also carries a solution decanting outlet 29, a sludge collection area 32, and an outlet 35 for sludge containing elemental gold from the bottom 38 of cell 20. This sludge needs only to be washed and filtered to obtain elemental gold, of a purity determined by the gold ore. Evolved gases are removed through outlet 35 during the electrowinning process. Lids 41 close cell body 23 tightly latched against seals, not shown. Anodes 44 and cathodes 47 are suspended within the ore solution within cell body 23, in the general location shown in FIG. 1. More representative actual cathode/anode spacings are shown in FIG. 6. Electrical bus bars are provided for applying voltage D.C. to the anodes 44, and to conduct induced voltage from the cathodes 47 away. Not shown in FIG. 1 is an electrical bus bar 1–50 for application of the voltage to the anodes 44 and a cathode bus bar 53, completing electrical circuits through the gold-bearing solution is shown in FIGS. 6 and 11.

Figure 2:
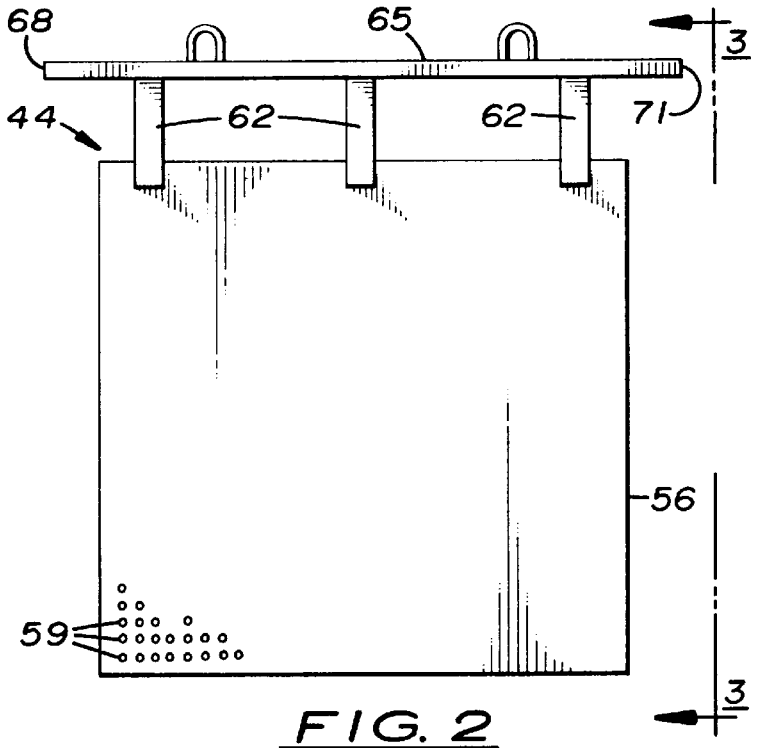
FIG. 2 (PRIOR ART)
FIG. 2, a front elevational view of such prior art anode.
Figure 3:
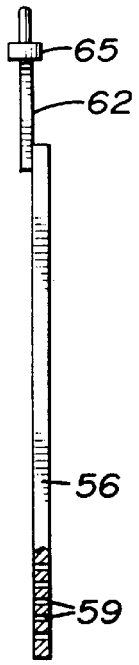
FIG. 3 (PRIOR ART)
FIG. 3, a partially broken side elevational view taken on the line 3—3 of FIG. 2 showing such prior art anode and the perforations through the anode plate.

Each anode assembly 44 comprises a plate 56 perforated (punched) over its entire area with flow-through holes 59. (FIGS. 2 and 3) Straps 62 suspend plate 56 from anode suspension bar 65, an end 68 of which rests upon the anode electrical bus bar 50, and an opposite end 71 which rests upon cell body 23 through a suitable insulator, not shown. (FIG. 10)

Figure 4:
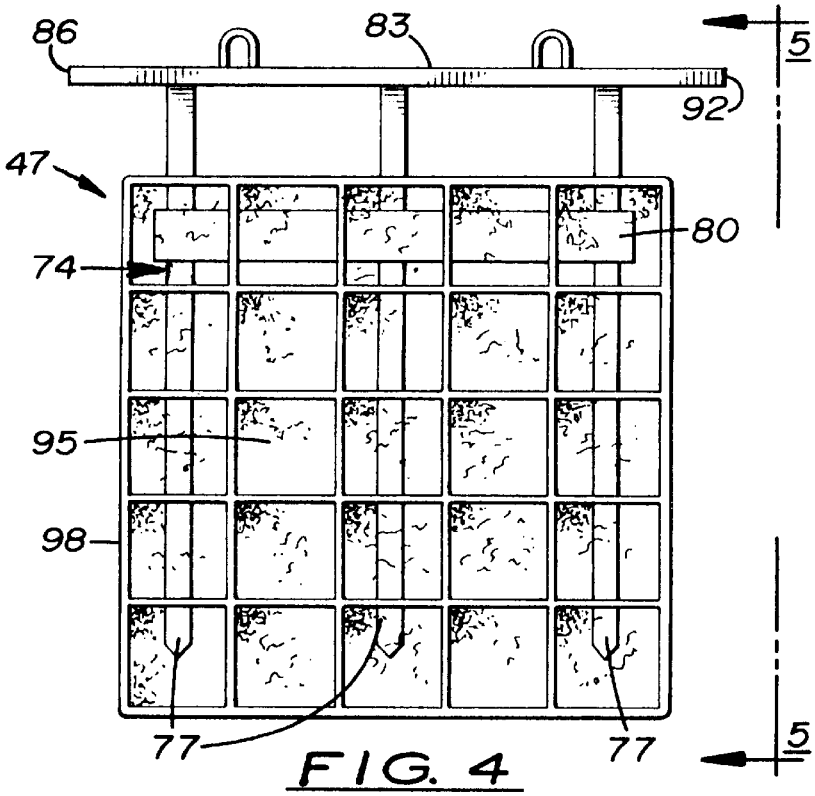
FIG. 4 (PRIOR ART)
FIG. 4, a front elevational view of such prior art basket type cathode showing the frame and the basket containing the steel wool.
Figure 5:
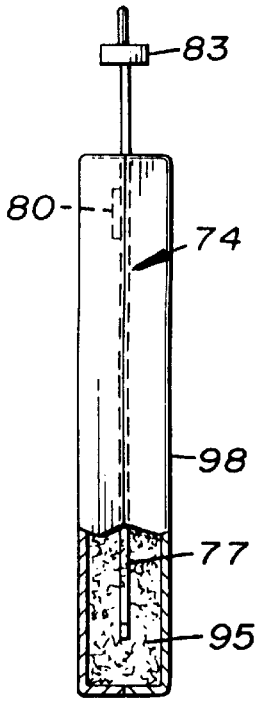
FIG. 5 (PRIOR ART)
FIG. 5, a partially broken side elevational view taken on the line 5—5 of FIG. 4 showing such prior art cathode.

Referring to FIGS. 4 and 5, prior art cathode 47 includes a frame assembly 74 comprising vertical 77 connected together by a horizontal tie bar 80, suspended by vertical bars 77 from a cathode suspension bar 83, which rests at an end 86 upon cathode bus bar 53 and at opposite end 92 upon cell body 23 through a suitable (not shown). Cathode 47 further includes steel wool 95 which surrounds frame assembly 74 and a baset 98 therearound to contain such steel wool 95.

The use of wool containing baskets 98 limits the capacity of cell 20 (FIG. 6). The thickness of basket 98 reduces the number of paired prior art cathodes 47 and anodes 44 which an be contained within cell 20, somewhat reducing the advantage provided by the large cathodic surface of woll 95. Cleaning of the deposited sludge requires removal of the prior art basket type cathode 47 from cell 20 for disassembly, thorough washing, and reassembly.

Figure 7:
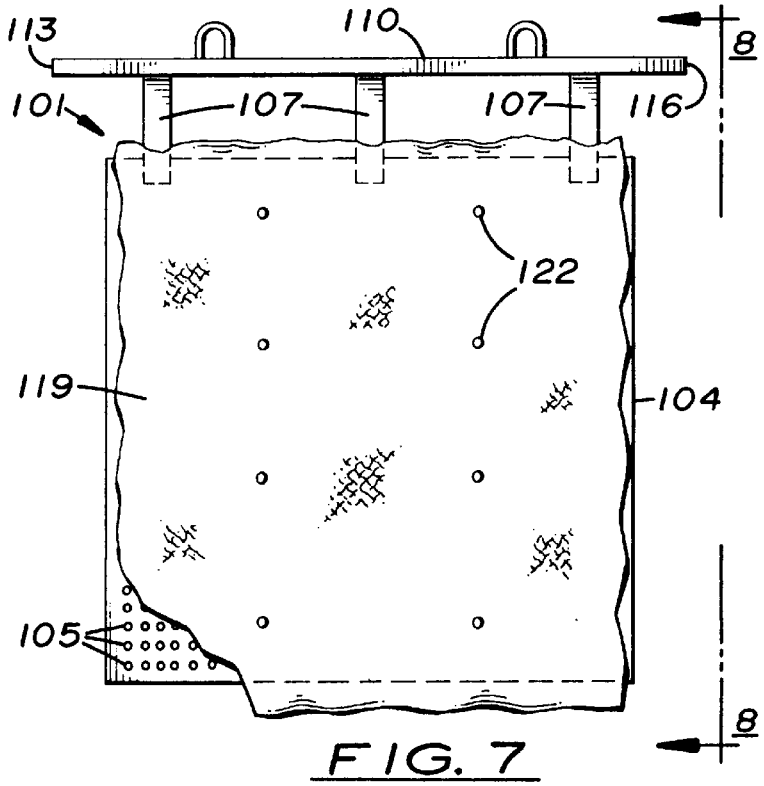
FIG. 7, a front elevational view of the inventive cathode showing the perforated plate covered by layers of wire mesh.
Figure 8:
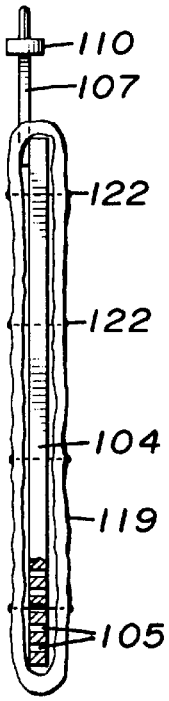
FIG. 8, a partially broken side elevational view of the inventive cathode taken on the line 8—8 of FIG. 7.
Figure 9:
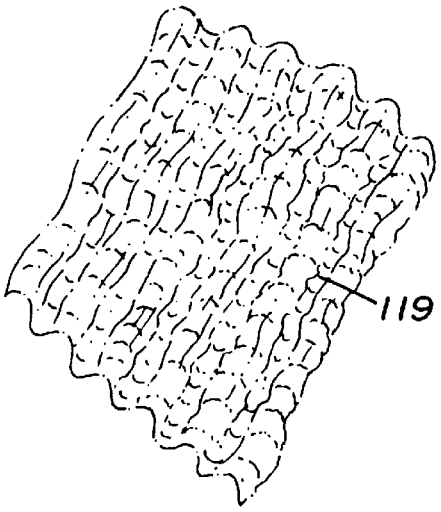
FIG. 9, a perspective view of a piece of crinkled wire mesh used in the invnetive cathode.
Figure 10:
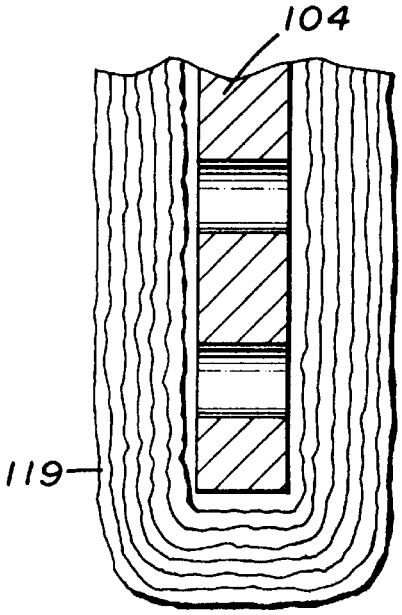
FIG. 10, a fragmentary cross sectional view, to an enlarged scale, of the invnetive cathode showing the perforations through the cathode plate and the layers of wire mesh wrapped therearound.

The inventive cathode 101 shown in FIGS. 7, 8, and 10 comprises a perforated plate 104 having a plurality of holes 105 therethrough, which may be identical to anode plate 56, and which is suspended by cathode support straps 107 from a cathode suspension bar 110, which rests at an end 113 upon cathode bus bar 53 and at opposite end upon cell body 23 through a suitable insulator, (not shown). Cathode plate 104 is surrounded by wrapped layers of stainless steel wire mesh 119, secured in place as by ratchet buttons 122 or other suitable securing devices, not shown. During operation of the electrowinning cell 20A, gold-bearing sludge is deposited upon individual wires throughout the layers of mesh 119, and upon cathode plate 27. Mesh 119 is knitted and preformed into small crinkles, to provide thickness to the wrappings, creating space between the woven wires for gold sludge buildup. (FIG. 9M)

Figure 12:
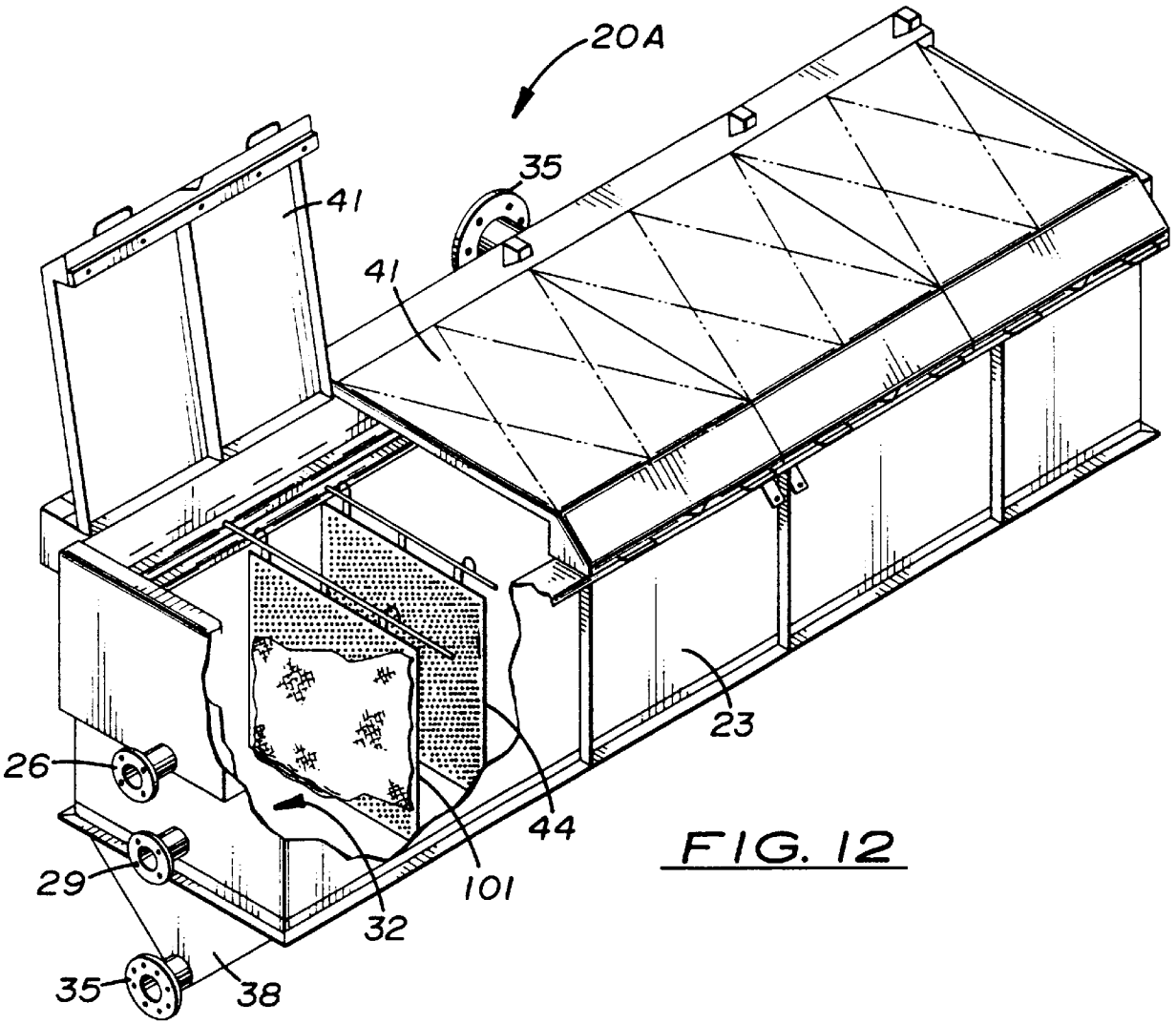
FIG. 12, a partially broken perspective view of such inventive electrwinning cell showing such prior art anode and the inventive cathode therein.

In contrast, the inventive cathodes 101 are easily cleaned without removal from cell 20A.(FIGS. 11 and 12) This is because the inventive cathode 101 incorporates strong, woven conductive mesh 119 wrapped about the cathode plate 104 is in which in an unobstructed easily reached position. Little time or effort is needed to dislodge the sludge from the full depth of the mesh layers. It has been found that, when the mesh 119 is attached in this manner, the direction of the sludge dislodging water may be parallel to the cathode punch plate (104 i.e. Vertical). An ordinary garden hose with spray nozzle 122 may be used for dislodging the sludge. (FIG. 11) As previously stated, the cathode 101 need not be removed from cell 20A for cleaning and for sludge recovery. It is only necessary to decant the electrolyte from cell 20A prior to the in cell dislodgment of the sludge from the mesh 119 of the cathode 101. With some electrolyte and ore solutions, it is possible to recover the sludge without interrupting the operation of cell 20A, advantageously for its operating efficiency.

Other embodiments than those illustrated and described may be within the spirit of the invention, the basic concept of which is to employ crinkled woven wire mesh to provide wire surface area for efficient deposition of gold-bearing sludge, and to provide said mesh in easily accessible position for in situ water spray cleaning in the cell. Accordingly, other means of successful support of the mesh than utilization of the heavy cathode plate might be devised. Indeed, the mesh layers could be self-supporting suspended from the cathode plate suspension bar 29, for example, albeit with sacrifice of strength and longevity of the cathode structure. A less radical departure might comprise stiff, large diameter wire hanging hooks in place of the illustrated cathode plate. Still other variations in cathode embodiments may also be within the spirit of the invention.

The inventive apparatus may be embodied in other specific forms, without departing from the spirit or essential characteristics thereof. The present apparatus is therefore to be considered illustrative and not restrictive, the scope of the invention being indicated by the appended claims rather than by the foregoing description and all changes which come within the meaning and range of equivalency of the claims are therefore intended to be embraced therein.

What is claimed and desired to be secured by United States Letters Patent is:

1. An electrowinning cell assembly for removal of at least one precious metal dissolved in an electrolyte solution, said cell having at least one anode and at least one cathode, said anode and said cathode being adapted to be spaced apart within said cell when said electrolyte is present therein, wherein the cathode comprises:

woven wire mesh; and means supporting said mesh suspended within the electrolyte solution, comprising a metallic plate adapted to be suspended within the electrolyte, said mesh being wrapped in at least one layer therearound in electrical contact therewith, said mesh being everywhere crinkled so as to outstand from said plate and from underlying mesh layers, wherein said cathode plate and said wire mesh are made of stainless steel.

2. The electrowinning cell assembly of claim 1, wherein the metallic plate is perforated.

3. The electrowinning cell assembly of claim 2, wherein the mesh is secured to the plate by securing means.

4. The electrowinning cell assembly of claim 3, wherein the securing means comprises wire ties.

5. The electrowinning cell assembly of claim 4, wherein the wire ties are made of stainless steel.

6. The electrowinning cell assembly of claim 3, wherein the securing means comprises ratchet buttons.

7. The electrowinning cell assembly of claim 6, wherein the ratchet buttons are made of stainless steel.

8. The electrowinning cell assembly of claim 1, wherein the mesh is secured to the plate by securing means.

9. The electrowinning cell assembly of claim 8, wherein the securing means comprises wire ties.

10. The electrowinning cell assembly of claim 9, wherein the wire ties are made of stainless steel.

11. The electrowinning cell assembly of claim 8, wherein the securing means comprises ratchet buttons.

12. The electrowinning cell assembly of claim 11, wherein the ratchet buttons are made of stainless steel.

13. The electrowinning cell assembly of claim 1, wherein the mash comprises wire of a diameter from about 0.0045 to 0.0100 inch.

14. The electrowinning cell assembly of claim 1, wherein there are from about four to six wraps of mesh around the plate.

* * * * *